US007427708B2

(12) United States Patent
Ohmura

(10) Patent No.: US 7,427,708 B2
(45) Date of Patent: Sep. 23, 2008

(54) TONE COLOR SETTING APPARATUS AND METHOD

(75) Inventor: Hiroko Ohmura, Hamamatsu (JP)

(73) Assignee: Yamaha Corporation (JP)

( * ) Notice: Subject to any disclaimer, the term of this patent is extended or adjusted under 35 U.S.C. 154(b) by 617 days.

(21) Appl. No.: 11/180,106

(22) Filed: Jul. 13, 2005

(65) Prior Publication Data

US 2006/0011047 A1 Jan. 19, 2006

(30) Foreign Application Priority Data

Jul. 13, 2004 (JP) ..... 2004-206554

(51) Int. Cl.
*G10H 7/00* (2006.01)
*G10H 1/00* (2006.01)
*G10H 1/02* (2006.01)
*G10H 1/06* (2006.01)

(52) U.S. Cl. ..... 84/622; 84/600; 84/611; 84/615; 84/626; 84/662

(58) Field of Classification Search ..... 84/622, 84/626, 662
See application file for complete search history.

(56) References Cited

U.S. PATENT DOCUMENTS 4,283,983 A * 8/1981 Kashio ..... 84/622
4,617,851 A * 10/1986 Sato ..... 84/622
5,048,390 A * 9/1991 Adachi et al. ..... 84/464 R
5,648,626 A * 7/1997 Okamoto ..... 84/600
5,663,514 A * 9/1997 Usa ..... 84/600
5,739,454 A * 4/1998 Kunimoto ..... 84/615
5,890,116 A * 3/1999 Itoh et al. ..... 704/260
5,998,724 A * 12/1999 Takeuchi et al. ..... 84/622
6,002,080 A * 12/1999 Tanaka ..... 84/615
6,072,113 A * 6/2000 Tohgi et al. ..... 84/470 R
7,022,907 B2 * 4/2006 Lu et al. ..... 84/611
7,132,596 B2 * 11/2006 Nakabo et al. ..... 84/615
7,217,878 B2 * 5/2007 Ludwig ..... 84/609
2003/0159567 A1 * 8/2003 Subotnick ..... 84/626
2004/0055448 A1 * 3/2004 Byon ..... 84/626
2006/0054007 A1 * 3/2006 Lu et al. ..... 84/611
2007/0131096 A1 * 6/2007 Lu et al. ..... 84/611
2007/0174274 A1 * 7/2007 Kim et al. ..... 707/5

FOREIGN PATENT DOCUMENTS

JP 9-325773 A 12/1997
JP 10187020 A 7/1998

* cited by examiner

*Primary Examiner*—Lincoln Donovan
*Assistant Examiner*—Christina Russell
(74) *Attorney, Agent, or Firm*—Rossi, Kimms & McDowell, LLP

(57) ABSTRACT

As the user executes a performance on a preliminary or trial basis, performance data based on the user's performance are evaluated, a performance tendency of the user is extracted as a result of the extraction, and then, performance tendency information, indicative of the extracted performance tendency, is generated. Psychological state, such as a mood or feeling, of the user is detected from the performance tendency, and feeling information, indicative of the detected psychological state, is generated. Then, tone color control information corresponding to the generated feeling information is acquired from a storage section, such as a "mood/feeling" vs. tone color control" correspondence table, the acquired tone color control information is delivered to a tone generator, and desired tone color parameters are set on the basis of the tone color control information. The thus-set tone color parameters will be used for tone color control of performance data generated as the user subsequently executes an actual, formal performance.

10 Claims, 2 Drawing Sheets

| No. | PERFORMANCE TENDENCY INFO. (PT) | FEELING INFO. (FL) | TONE COLOR CONTROL INFO. (TC) |
|---|---|---|---|
| | USERS PERFORMANCE TENDENCY | MOOD FEELING | CONTENTS OF TONE COLOR CONTROL |
| 1 | RATHER LEGATO | RELAXED | IMPART EFFECT, OR MAKE SETTING FOR DEEP VIBRATO |
| 2 | GENERALLY WEAK IN VELOCITY | TIRED | SET VELOCITY OFFSET TO RELATIVELY GREAT VALUE |
| 3 | GENERALLY STRONG IN VELOCITY | FINE/IN GOOD SHAPE | SET VELOCITY SUCH THAT GREAT VARIATION IS ACHIEVED WITH A LITTLE TOUCH |
| 4 | RATHER FAST IN TEMPO | HASTY | DECREASE VALUE OF ATTACK TIME OF EG SO AS TO QUICKEN RISE OF TONE |
| 5 | RATHER SLOW IN TEMPO | RELAXED | IMPART EFFECT, OR MAKE SETTING FOR DEEP VIBRATO |
| 6 | MANY MISTAKES | TIRED | SET VELOCITY OFFSET TO RELATIVELY GREAT VALUE |
| 7 | FEW MISTAKES | FINE/IN GOOD SHAPE | SET VELOCITY SUCH THAT GREAT VARIATION IS ACHIEVED WITH A LITTLE TOUCH |
| ⋮ | ⋮ | ⋮ | ⋮ |

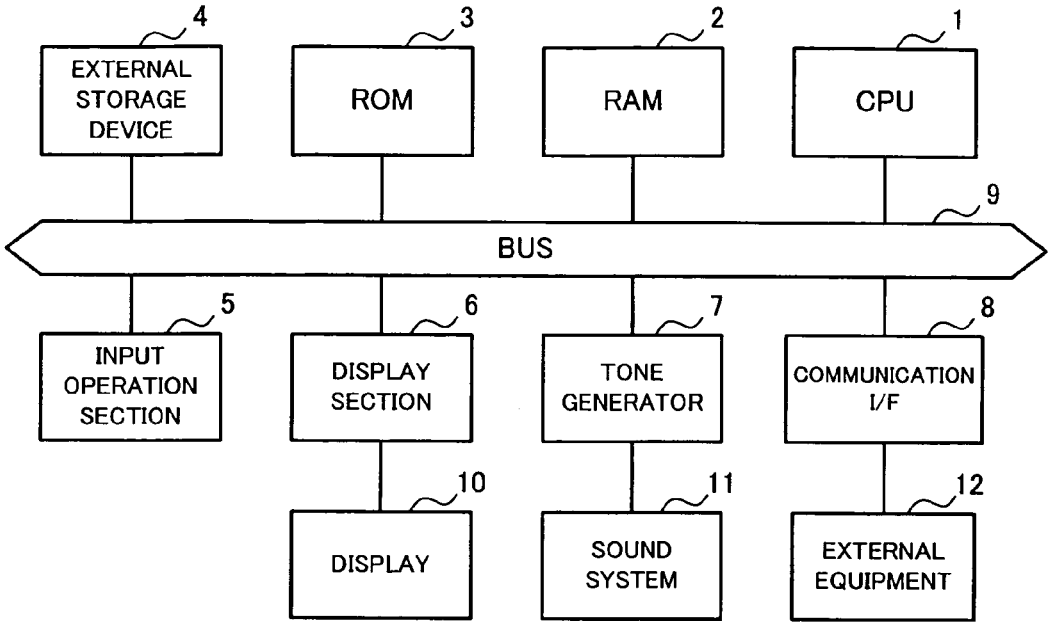

F I G. 1

| No. | PERFORMANCE TENDENCY INFO. (PT) | FEELING INFO. (FL) | TONE COLOR CONTROL INFO. (TC) |
|---|---|---|---|
| | USERS PERFORMANCE TENDENCY | MOOD FEELING | CONTENTS OF TONE COLOR CONTROL |
| 1 | RATHER LEGATO | RELAXED | IMPART EFFECT, OR MAKE SETTING FOR DEEP VIBRATO |
| 2 | GENERALLY WEAK IN VELOCITY | TIRED | SET VELOCITY OFFSET TO RELATIVELY GREAT VALUE |
| 3 | GENERALLY STRONG IN VELOCITY | FINE/IN GOOD SHAPE | SET VELOCITY SUCH THAT GREAT VARIATION IS ACHIEVED WITH A LITTLE TOUCH |
| 4 | RATHER FAST IN TEMPO | HASTY | DECREASE VALUE OF ATTACK TIME OF EG SO AS TO QUICKEN RISE OF TONE |
| 5 | RATHER SLOW IN TEMPO | RELAXED | IMPART EFFECT, OR MAKE SETTING FOR DEEP VIBRATO |
| 6 | MANY MISTAKES | TIRED | SET VELOCITY OFFSET TO RELATIVELY GREAT VALUE |
| 7 | FEW MISTAKES | FINE/IN GOOD SHAPE | SET VELOCITY SUCH THAT GREAT VARIATION IS ACHIEVED WITH A LITTLE TOUCH |
| ⋮ | ⋮ | ⋮ | ⋮ |

F I G. 2

TONE COLOR SETTING APPARATUS AND METHOD

BACKGROUND OF THE INVENTION

The present invention relates to a tone color setting system for setting a tone color of tones, generated by an electronic musical instrument or other tone generating equipment, such that the set tone color appropriately fits a user's mood or feeling detected through evaluation of user's performance data (i.e., performance data generated on the basis of a performance by the user).

Heretofore, various techniques or devices have been proposed for using evaluated results of user's performance data in a subsequent user's performance and for readily setting a desired tone color in an electronic musical instrument. For example, a performance practice assisting apparatus disclosed in U.S. Pat. No. 6,072,113 corresponding to Japanese Patent Application Laid-open Publication No. HEI-10-187020 is arranged to, in order to assist user's performance practice, compare a user's performance with data of a test music piece so as to analyze contents and causes of erroneously-performed positions and then present the user with an optimal practicing music piece on the basis of the analyzed results. Further, a tone color adjustment apparatus disclosed in Japanese Patent Application Laid-open Publication No. HEI-9-325773 is arranged to allow even a user unfamiliar with tone color parameters to readily adjust a particular tone color parameter so that a tone color of a desired image can be obtained.

However, with the conventionally-known apparatus that evaluates a user's performance, the detected information only represents the number and types of mistakes made by the user; it never represents a state, such as a mood or feeling, of the user. Further, with the conventionally-known tone color adjustment apparatus, it is impossible to set a tone color fitting a state, such as a mood or feeling, the user was in during a performance.

SUMMARY OF THE INVENTION

In view of the foregoing, it is an object of the present invention to provide a tone color setting system which, on the basis of a user's actual performance, can automatically set a tone color fitting a psychological state, such as a mood or feeling, of the user.

In order to accomplish the above-mentioned object, the present invention provides an improved tone color setting apparatus, which comprises: a performance input section that inputs performance data based on a performance by a user; a tendency extraction section that extracts a performance tendency of the user from the input performance data; a feeling detection section that generates feeling information indicative of a mood or feeling of the user presumed on the basis of the performance tendency extracted by said tendency extraction section; a storage section having tone color control information prestored therein in association with a plurality of kinds of feeling information; an acquisition section that acquires, from the storage section, tone color control information corresponding to the generated feeling information; and a tone color setting section that sets a tone color parameter on the basis of the acquired tone color control information.

According to the present invention, a plurality of pieces of tone color control information is prestored in association with a plurality of pieces (i.e., kinds) of feeling information (which may also be called "psychological state information"). Here, the plurality kinds of feeling information are indicative of psychological states, such as moods or feelings (e.g., "rather relaxed", "rather tired", "fine (in good shape)" and "rather hasty"), of the performing user. The plurality of pieces of tone color control information are each intended to vary a tone color parameter capable of adjusting a tone color, such as the type of the tone color, effect, depth of a vibrato, offset value and variation rate of velocity and attack time of an envelope generator. In the storage section, the plurality of pieces of tone color information, reflecting therein user's moods or feelings represented by the plurality of kinds of feeling information, are stored, for example as a "mood/feeling vs. tone color control" correspondence table, in association with the feeling information.

In the tone color setting apparatus, as the user executes a performance on a preliminary or trial basis by operating a performance operator, such as a keyboard, performance data based on the user's performance are input to the apparatus and temporarily stored into a RAM or the like. After termination of the user's performance, the performance data temporarily stored on the basis of the user's performance are evaluated in accordance with a predetermined algorithm. As a result of the evaluation, a tendency of the user's performance is extracted, and performance tendency information, indicative of the extracted performance tendency of the user, is generated. Then, a psychological state, such as a mood or feeling, of the user during the performance is detected from the extracted performance tendency, and feeling information, indicative of the detected mood/feeling (psychological state), is generated. Further, tone color control information corresponding to the generated feeling information is acquired, for example, in accordance with the "mood/feeling vs. tone color control" correspondence table stored in the storage section, and the thus-acquired tone color control information is delivered to a tone generator. Then, a desired parameter is set into the tone generator in accordance with the delivered tone color control information, and the thus-set tone color parameter will be used for tone color control of performance data generated as the user subsequently executes an actual, formal (i.e., non-trial) performance.

Namely, as the user actually executes a performance, the tone color setting apparatus automatically evaluates performance data based on the user's performance, extracts a user's performance tendency, detects a psychological state, such as a mood or feeling, of the user, and sets a tone color parameter in accordance with tone color information corresponding to the detected mood or feeling. Thus, in a subsequent performance by the user, the tone color of performance data based on the subsequent performance can be controlled to become such a tone color that fits the user's mood or feeling detected in the above-mentioned manner. Therefore, by the user only actually executing a performance, the tone color setting apparatus can automatically prepare a tone color parameter fitting a psychological state, such as a mood or feeling, of the user, even where the user has a clear image of the tone color. As a result, the present invention can provide an electronic musical instrument with a novel tone color control function which may be called a "feeling-responsive electronic musical instrument".

Further, according to the tone color setting apparatus of the present invention, a model music piece may be determined in advance, and model music piece data representing the model music piece may be preset as dedicated data to be used for extraction of a performance tendency. Thus, as the user performs the model music piece, model music piece performance data, entered by the user's performance, are compared with the preset model music piece data, so that a user's performance tendency can be extracted in a stable manner.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which:

FIG. 1 is a block diagram showing an example hardware setup of a tone color setting system in accordance an embodiment of the present invention;

FIG. 2 is a diagram showing example correspondence among performance tendencies of a user, moods or feelings of the user and contents of tone color control.

DETAILED DESCRIPTION OF THE INVENTION

[System Setup]

Figure 3:
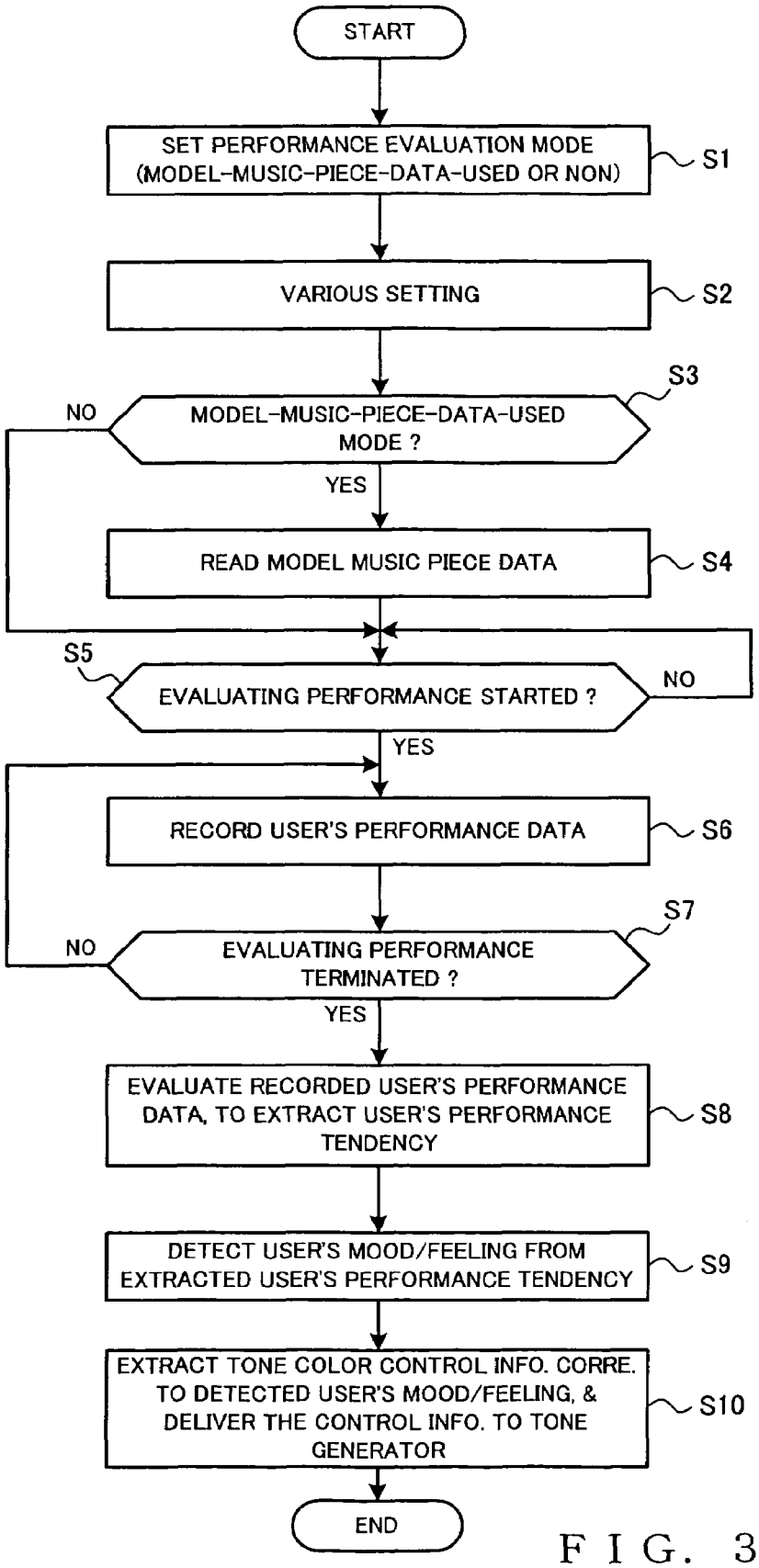
FIG. 3 is a flow chart showing an example operational flow of a tone color setting process (automatic tone color setting) performed in the embodiment of the present invention.

FIG. 1 is a block diagram showing an example hardware setup of a tone color setting system in accordance an embodiment of the present invention. In this tone color setting system, a music-specialized information processing apparatus (computer), such as an electronic musical instrument, is used as a tone color setting apparatus. Alternatively, the tone color setting apparatus may be in the form of a general-purpose information processing apparatus, such as a personal computer, that has performance input and tone generation functions added thereto. The tone color setting apparatus includes a central processing unit (CPU) 1, a random access memory (RAM) 2, a read-only memory (ROM) 3, an external storage device 4, an input operation section 5, a display section 6, a tone generator section 7, a communication interface (I/F) 8, etc., and these components 1-8 are interconnected via a bus 9.

The CPU 1, which controls the entire tone color setting apparatus, carries out various processes in accordance with various control programs, and particularly performs a tone color setting process in accordance with a tone color setting program included in the control programs. The RAM 2 functions as a processing buffer for temporarily storing various information to be used in the processes. For example, in the tone color setting process, the RAM 2 can store performance data based on a user's performance, performance data of a model music piece (i.e., model music piece data), etc.

Further, the Rom 3 has prestored therein various control programs, necessary control data and various other data, such as performance data. For example, the ROM 3 may prestore therein the above-mentioned tone color setting program, model music piece data, etc. The tone color setting program may include evaluation algorithms, such as "check/extraction rules" for checking user's performance data about predetermined performance evaluation items or factors to thereby extract a performance tendency, "performance tendency vs. mood/feeling" correspondence table and "mood/feeling vs. tone color control" correspondence table.

The external storage device 4 is in the form of storage media, such as a hard disk (HD), compact disk-read-only memory (CD-ROM), flexible disk (FD), magneto optical (MO) disk, digital versatile disk (DVD) and/or memory card. The tone color setting program, music piece data, various programs and other data may be stored in the external storage device 4 in place of or in addition to the ROM 3.

Where a particular control program, such as the tone color setting program, is not prestored in the ROM 3, the control program may be prestored in the external storage device (e.g., HD or CD-ROM) 4, so that, by reading the control program from the external storage device 4 into the RAM 2, the CPU 1 is allowed to operate in exactly the same way as in the case where the particular control program is stored in the ROM 3. This arrangement greatly facilitates version upgrade of the control program, addition of a new control program, etc. Further, a desired tone color setting apparatus can be provided by installing a program to be used in the tone color setting process, necessary control parameters, music piece data, etc.

The input operation section 5 includes: various panel operators (keys, buttons, mouse, etc.) for the user to perform switch operation to, for example, turn on/off a power supply, start tone color setting, perform mode setting and terminate a test or trial performance and also perform various other setting operation, editing operation, etc.; an operation section including a performance operator, such as a keyboard; and an operation detection circuit. The operation detection circuit detects contents of performance operation and panel operation executed by the user using the above-mentioned operators, and it supplies corresponding input information into the body of the system.

The display section 6 controls displayed contents and illumination states of a display device 10 including a display (such as a CRT, LCD and/or the like) connected thereto and lamp indicators, in accordance with instructions from the CPU 1; thus, the display section 6 provides displayed assistance to operation, by the human operator, on the input operation section 5.

The tone generator section 7 includes a tone generator (including software) and an effect imparting DSP. The tone generator section 7 generates tone signals corresponding to performance data based on performance operation by the user via the performance operator (5) (hereinafter referred to as "user's performance data") and performance data stored in the storage means 3, 4 etc. Sound system 11 connected to the tone generator section 7 includes a D/A converter, amplifier and speaker and generates a tone based on a tone signal from the tone generator 7.

Further, the communication interface 8 collectively represents at least some of a local area network (LAN), Internet, ordinary communication network, such as a telephone line network, and various interfaces connected to a MIDI network, and the communication interface 8 can communicate various information with various other computers, such as servers, and various external equipment 12, such as MIDI equipment.

Where any desired control program or data is not prestored in the apparatus, the desired control program or data may be downloaded from another computer (external equipment 12)

via the communication I/F 8. The external equipment 12 includes various devices, such as another performance data input device (e.g., MIDI keyboard) and performance data output device, and, via the communication I/F 8, it can receive user's performance data and transmit various performance data.

[Overview of Tone Color Setting]

The instant embodiment of the tone color setting system is arranged to: extract a performance tendency of the user by, in accordance with the tone color setting program, evaluating/analyzing user's performance data based on user's performance operation; detect a psychological state, such as a mood or feeling, of the user from the extracted performance tendency; determine contents of tone color control corresponding to the detected psychological state; and then automatically set tone color parameters in accordance with the determined contents of tone color control. That is, subsequent user's performance data (i.e., performance data generated on the basis of a subsequent performance by the user) can be controlled, in accordance with the set tone color parameters, to have a tone color fitting or reflecting therein the previously-detected user's mood or feeling.

First, for the evaluation of a user's performance, there are preset two evaluation modes, i.e. "model-music-piece-data used" mode and "no model-music-piece-data used" mode. In either one of the evaluation modes designated by the user, various performance evaluation items (performance evaluation factors) in the user's performance data are checked, in accordance with check/extraction rules (algorithms) preset in the tone color setting program, so as to extract a performance tendency of the user from the performance data. As such check/extraction rules (e.g., schemes for checking mistouches, timing errors or deviations, etc.), there may be employed conventionally-known check/extraction schemes.

In the "model-music-piece-data used" mode, once the user performs a model music piece for a predetermined period of time, performance data based on the user's performance operation are compared with the performance data of the model music piece (i.e., model music piece data) to check the various performance evaluation items and generate performance evaluation information for the individual items, like "rather legato/rather staccato", "generally weak/strong in velocity", "fast/slow in tempo" (rather faster/slower in timing) and "many/few mistouches", to thereby extract a performance tendency. Although there may be prepare or preset only one model music piece, it is preferable to prepare a plurality of model music pieces so that the user can select a desired one of the model music pieces in executing the performance evaluation. For example, one or more model music pieces may be preset for each musical genre or level of difficulty, in which case a model music piece of the same musical genre or level of difficulty as an actual, formal performance can be selected as a model for the performance evaluation; such arrangements permit clearer tone color setting.

In the "no model-music-piece-data used" mode, on the other hand, a separate reference is set for each of the various performance evaluation items, and performance evaluation information, indicative, for example, of whether or not the user often performs better than the references for the individual performance evaluation items, to thereby extract a performance tendency of the user; for example, a reference for velocity may be set so that performance evaluation information, indicative, for example, of whether or not the user often performs better than the velocity reference, can be generated.

Further, the user's performance may be evaluated after the user has performed an entire music piece, or after the user has performed a predetermined section, such as several predetermined measures, of a music piece. Further, it is preferable that the section (or range) of a music piece performance to be evaluated be set by the user prior to the evaluation.

In detecting a psychological state, such as a mood or feeling, of the user, the instant embodiment uses the "performance tendency vs. mood/feeling" correspondence table that is contained in the tone color setting program. For example, if the user's performance tendency is "rather legato" or "rather slow in tempo", it can be presumed that the user is in a relaxed mood. Also, if the user's performance tendency is "generally strong in velocity" or "few mistakes", it can be presumed that the user is fine or in good shape. Thus, in the "performance tendency vs. mood/feeling" correspondence table, there are recorded pieces of feeling information (FL: psychological state information) indicative of moods and feelings, such as "relaxed" and "fine/in good shape", presumable from individual user's performance tendencies, in association with pieces of performance tendency information (PT) indicative of various performance tendencies.

Thus, once a performance tendency (PT) of the user is extracted in accordance with the check/extraction rules, it is possible to acquire particular feeling information (FL) corresponding to the extracted performance tendency (PT), in accordance with the "performance tendency vs. mood/feeling" correspondence table. The "performance tendency vs. mood/feeling" correspondence table may be arranged to be updatable in contents so that desired contents can be set by the user editing the correspondence between the performance tendencies and the psychological states (moods/feelings).

Further, in determining contents of the tone color control, the instant embodiment uses the "mood/feeling" vs. tone color control" correspondence table that is also contained in the tone color setting program. In this correspondence table, there are recorded pieces of tone color control information (TC), indicative of contents of tone color control fitting user's psychological states represented by a plurality of pieces of feeling information (FL), in association with the pieces of feeling information (FL).

Various tone-color-related parameters, with which to process performance data for audible reproduction, can be set in the tone generator section 7. The various tone-color-related parameters include parameters pertaining to types of tone colors (e.g., groups of tone colors, such as various pianos, organs and guitars, and/or bank types in the individual tone color groups), effects (e.g., chorus, reverberation and distortion), vibrato, velocity, EG (Envelope Generator), LFO (Low Frequency Oscillator), key scaling, filter, etc. These parameters will hereinafter be referred to as "tone color parameters".

The embodiment of the tone color setting system selects particular tone color parameters, capable of reflecting a particular user psychological state (FL), from among the above-mentioned tone color parameters, using the "mood/feeling" vs. tone color control" correspondence table. Then, the tone color setting system sets contents of the selected tone color parameters to fit the user's psychological states (FL), to thereby perform tone color control. Note that the tone color control represented by the tone color control information (TC) may be set or edited to any contents as desired by the user.

[Specific Example of Tone Color Setting]

FIG. 2 shows example correspondence among the performance tendencies of the user, moods or feelings of the user and the contents of the tone color control. Here, a general description will be given about the embodiment of the tone color setting system, with reference to FIG. 2. As the user executes a performance on a preliminary or trial basis in the tone color setting system, performance data based on the user's performance are evaluated, a user's performance tendency is extracted as a result of the extraction, and then, performance tendency information PT, indicative of the extracted performance tendency of the user, is generated. Psychological state, such as a mood or feeling, of the user are detected from the performance tendency, and feeling information FL, indicative of the detected psychological state, is generated. Then, tone color control information corresponding to the generated feeling information FL is acquired from the storage means, such as the "mood/feeling" vs. tone color control" correspondence table, the acquired tone color control information TC is delivered to the tone generator section 7, and desired tone color parameters are set on the basis of the tone color control information TC. The thus-set tone color parameters will be used for tone color control of performance data generated as the user subsequently executes an actual, formal performance.

The correspondence among the performance tendencies of the user, moods or feelings of the user and the contents of the tone color control will be described in greater detail. If the evaluation of the user's performance data indicates that the user's performance has a tendency that adjoining notes slightly overlap each other, it is determined, in the system of the present invention, that the user's performance tendency (PT) is "rather legato". Instance No. 1 in FIG. 2 shows an example of the correspondence in such a case. Namely, when a user's performance tendency (PT) of "rather legato" has been extracted, it is presumed (detected), in accordance with the "performance tendency vs. mood/feeling" correspondence table, that the user's mood or feeling is "relaxed". In correspondence with the presumption (detection) (FL) and in accordance with the "mood/feeling" vs. tone color control" correspondence table, tone color control information TC is generated (acquired) which imparts an effect or increases a value of a vibrato depth (i.e., width over which to swing the tone pitch) parameter to thereby make a setting for a deep vibrato.

Further, when a user's performance tendency (PT) of "generally weak in velocity" has been extracted as shown in Instance No 2, it is presumed that the user's mood or feeling (FL) is "tired", in correspondence with which tone color control (TC) is performed to set a velocity offset to a relatively great value. Namely, in this tone color control (TC), a "velocity sense offset" parameter for uniformly increasing/decreasing a velocity value operating on the tone generator section 7 is set to a relatively great value.

Further, when a user's performance tendency (PT) of "generally strong in velocity" has been extracted as shown in Instance No 3, it is presumed that the user's mood or feeling (FL) is "fine/in good shape", in correspondence with which tone color control (TC) is performed to set the velocity such that a great velocity variation is achieved with a little touch. Namely, in this tone color control (TC), a "velocity sense depth" parameter for controlling degree (inclination) of a velocity variation operating on the tone generator section 7 with respect to intensity with which to play the keyboard of the input operation section 5 is set to a maximum value, while the "velocity sense offset" parameter for uniformly increasing/decreasing a velocity value operating on the tone generator 7 is set to a relatively small value.

Further, when a user's performance tendency (PT) of "rather fast in tempo" has been extracted as shown in Instance No 4, it is presumed that the user's mood or feeling (FL) is "hasty", in correspondence with which tone color control (TC) is performed to decrease a value of an attack time of the EG so as to make a setting to quicken a rise of a tone. Namely, this tone color control (TC) sets a small value of an attack time parameter such that the time necessary for a tone volume at a time point when the keyboard has been played increases from zero to a maximum value is shortened. When a user's performance tendency (PT) of "rather slow in tempo" has been extracted as shown in Instance No 5, on the other hand, it is presumed that the user's mood or feeling (FL) is "relaxed", tone color control (TC) imparts an effect or make a setting for a deep vibrato as in the No. 1 instance.

Furthermore, when a user's performance tendency (PT) of "many mistakes" has been extracted as shown in Instance No 6 and it has been presumed that the user's mood or feeling (FL) is "tired", tone color control (TC) sets the velocity offset to a relatively great value as in the No. 2 instance. Furthermore, when a user's performance tendency (PT) of "few mistakes" has been extracted as shown in Instance No 7 and it has been presumed that the user's mood or feeling (FL) is "fine/in good shape", tone color control (TC) is performed to set the velocity such that a great velocity variation is achieved with a little touch as in the No. 3 instance.

[Various Tone Color Setting Modes]

Although the extraction of the user's performance tendency may be performed by comparison with the model music piece data as set forth above, the user's performance tendency may be extracted from the user's performance data alone, except where the model music piece data are particularly needed, e.g., in the No. 6 and No. 7 instances above where the tendency of "many/few mistakes" has to be determined accurately. Namely, instead of the model music piece data being used, reference values may be set for the individual evaluation items (performance evaluation factors), e.g. velocity reference value of "64", tempo reference value of "100" and so on. For the No. 6 and No. 7 instances as well, the performance evaluation may be made without a model music piece if a reference value of a mistouch rate is set on the basis of previous performance records of the user. In such a case, there may be cumulatively stored data indicative of previous records related to the user's performance capability.

Whereas only a part of the correspondence among the performance tendencies of the user, moods or feelings of the user and the contents of the tone color control has been described above for simplicity, various other performance tendencies, moods/feelings and contents of tone color control may be variously associated with one another. For example, the types of the user's moods/feelings to be detected may be other than those in the illustrated example, and the correspondency between the performance tendencies (states) and moods/feelings may other than those in the illustrated example. Further, the types of the items to be associated with one another and the correspondence among them may be made editable by the user.

Further, to detect the user's mood or feeling, specific rules (algorithms) for determining the mood or feeling may be used in place of the above-described "performance tendency vs. mood/feeling" correspondence table. Namely, instead of using the correspondence table, the instant embodiment may score the user's performance individually for the plurality of performance evaluation items and use mood/feeling determination rules for presuming a mood or feeling of the user by executing one or more predetermined algorithms. In this case, the user's mood or feeling may be presumed from a combination of a plurality of performance tendencies, rather than from just one performance tendency.

Whereas the tone color control has been described above as adjusting only a limited number of tone color parameters for simplicity of description, the tone color control performed in the instant embodiment may adjust any other tone color parameters. Further, as stated above, the "tone color parameters" to be adjusted or controlled by the tone color control in the instant embodiment may include any parameters related to tone colors with which to sound or audibly reproduce performance data.

Therefore, groups of tone colors (voices) of various pianos, organs, guitars, etc. and bank types specifying a fundamental or extended tone color (voice) in each of the tone color groups (these tone color groups and bank types are generically referred to as "tone color types") are also tone color parameters, and thus, a tone color (voice) itself may be changed by designating any one of such tone color types. For example, a tone color (e.g., fundamental voice) of a preset original bank type can be changed to a slightly different tone color (e.g., extended voice) by designating a bank type (number) that is different from the original bank type but belongs to a tone color group (e.g., grand piano) of a same program number as the original bank type.

Furthermore, the correspondence between the detected moods/feelings and the contents of the tone color parameters is not limited to the above-described and may be made editable by the user. The contents of the tone color control are not limited to the above-described and may comprise suitably-adjusted values of a plurality of tone color parameters.

Moreover, the tone color control (tone color adjustment) may be either kept in the same condition as originally determined in an initial performance, such as a trial performance, until the power supply is turned off, or caused to vary in a real-time fashion in accordance with subsequent performance evaluation. In the latter case, the above-described tone color setting may be performed on a subsequent performance by the user every predetermined time (e.g., every 30 minutes).

[Example Operational Flow of Tone Color Setting]

FIG. 3 is a flow chart showing an example operational flow of the tone color setting process (automatic tone color setting) performed in the embodiment of the present invention. The tone color setting process is start up, in accordance with the tone color setting program, in response to tone color setting operation by the user on the operation section 5. At first step S1 of the tone color setting process, the performance evaluation mode is set, in response to mode setting operation by the user, to the "model-music-piece-data-used" mode or "non-model-music-piece-data-used" mode. If the performance evaluation mode is set to the "model-music-piece-data-used" mode, the user is allowed to designate or select a model music piece in accordance with displayed guidance on the display 10.

At next step S2, various setting operations are performed. The "various setting operations" include editing/setting of the performance tendency check/extraction rules (e.g., setting to not evaluate mistouches, and threshold value change, deletion or evaluation level change of a particular performance evaluation item), editing/setting of correspondence between the performance tendencies and moods/feeling of the user (e.g., deletion or selection of particular correspondence), editing/setting of the tone color control information TC corresponding to the mood/feeling of the user (e.g., deletion or selection of particular tone color control, or parameter value change), setting of a range of the performance evaluation (e.g., setting the performance evaluating range to the whole of a music piece or particular section of the music piece), etc.

At following step S3, it is determined whether the performance evaluation mode is currently set to the "model-music-piece-data-used" mode. If the performance evaluation mode is currently set to the "model-music-piece-data-used" mode (YES determination at step S3), the process moves on to step S4, where the model music piece data, i.e. performance data of the music piece selected as the model music piece, are read into a model-music-piece-data recording area of the RAM 2 and then the user is prompted, via the display 10, to perform the model music piece. After step S4, the process proceeds to step S5. If, on the other hand, the performance evaluation mode is currently set to the "non-model-music-piece-data-used" mode (NO determination at step S3), the process goes to step S5 after only prompting the user to perform a music piece.

At step S5, a determination is made as to whether a trial performance (evaluating performance) has been started by the user operating the performance operator 5 for the performance evaluation purpose. If the trial performance (evaluating performance) has not yet been started by the user (NO determination at step S5), the process waits for the user to start the evaluating performance. If the evaluating performance has been started by the user (YES determination at step S5), performance data based on the evaluating performance by the user are sequentially recorded into a performance data recording area of the RAM 2. Then, at step S7, a determination is made as to whether the evaluating performance by the user has been terminated, e.g. whether the performance of the evaluating range has been completed or whether the user has performed particular operation for terminating the trial performance. If answered in the negative at step S7, the performance data recording is continued at step S6, and then the process reverts to the determination at step S7.

Upon termination of the evaluating performance by the user (YES determination at step S7), the process moves on to step S8, where the user's performance data recorded in the RAM 2 are evaluated to extract a performance tendency of the user and thereby generate performance tendency information PT. If the current performance evaluation mode is the "model-music-piece-data-used" mode, the user's performance data are evaluated by being compared, in accordance with the performance tendency check/extraction rules, with the model music piece data. If the current performance evaluation mode is the "non-model-music-piece-data-used" mode, on the other hand, the user's performance data are evaluated by being compared with, for example, reference values set individually for the predetermined performance evaluation items.

At following step S9, a user's mood or feeling is detected from the extracted user's performance tendency (PT) in accordance with the "performance tendency vs. mood/feeling" correspondence table or the mood/feeling determination rules, to thereby generate feeling information FL. Then, at step S10, tone control information TC corresponding to the feeling information FL, representative of the detected user's mood or feeling, is extracted in accordance with the "mood/feeling" vs. tone color control" correspondence table and the extracted tone control information TC is delivered to the tone generator, after which the tone color setting process is brought to an end.

[Modification]

The present invention may be practiced in various manners other than the above-described embodiment. For example, the detected "mood/feeling" may be visually or audibly displayed (presented) to the user, and the user may be prompted to enter a response as to whether he or she agrees to the presented "mood/feeling". Then, the contents of the "performance tendency vs. mood/feeling" correspondence table may be updated on the basis of the entered response, or the entered response may be learned.

What is claimed is:

1. A tone color setting apparatus comprising:

a performance input section that inputs performance data based on a performance by a user;

a tendency extraction section that extracts a performance tendency of the user from the performance data inputted via said performance input section;

a feeling detection section that generates feeling information indicative of a mood or feeling of the user presumed on the basis of the performance tendency extracted by said tendency extraction section;

a storage section having tone color control information prestored therein in association with a plurality of kinds of feeling information;

an acquisition section that acquires, from said storage section, tone color control information corresponding to the feeling information generated by said feeling detection section; and a tone color setting section that sets a tone color parameter on the basis of the tone color control information acquired by said acquisition section.

2. A tone color setting apparatus as claimed in claim 1 which further comprises a model music piece supply section that supplies model music piece data, and wherein said tendency extraction section compares the performance data, inputted via said performance input section, with the model music piece data, to extract a performance tendency of the user.

3. A tone color setting apparatus as claimed in claim 2 wherein said tendency extraction section compares the performance data, inputted via said performance input section, with the model music piece data about a plurality of kinds of performance evaluation items and generates performance evaluation information for each of the items on the basis of a result of the comparison, to thereby extract the performance tendency of the user.

4. A tone color setting apparatus as claimed in claim 1 wherein said tendency extraction section evaluates the performance data, inputted via said performance input section, about a plurality of kinds of performance evaluation items, to thereby extract the performance tendency of the user.

5. A tone color setting apparatus as claimed in claim 1 wherein said tendency extraction section stores previous performance record data of the user and extracts a current performance tendency on the basis of a comparison between the performance record data and the performance data inputted via said performance input section.

6. A tone color setting apparatus as claimed in claim 1 wherein said feeling detection section generates the feeling information, on the basis of the extracted performance tendency, with reference to a table predefining correspondence between performance tendencies and feeling information.

7. A tone color setting apparatus as claimed in claim 1 wherein said feeling detection section generates the feeling information, on the basis of the extracted performance tendency, by executing a predetermined algorithm for determining a mood or feeling.

8. A tone color setting apparatus as claimed in claim 1 wherein said feeling detection section includes a conversion section that converts information indicative of the performance tendency, extracted by said tendency extraction section, into corresponding feeling information.

9. A tone color setting method comprising:

a step of inputting performance data based on a performance by a user;

a step of extracting a performance tendency of the user from the performance data inputted via said step of inputting;

a step of generating feeling information indicative of a mood or feeling of the user presumed on the basis of the performance tendency extracted by said step of extracting;

a step of acquiring tone color control information corresponding to the feeling information generated by said step of generating; and a step of setting a tone color parameter on the basis of the tone color control information acquired by said step of acquiring.

10. A computer program, stored on a computer readable medium, containing a group of instructions for causing a computer to perform a tone color setting method, said tone color setting method comprising:

a step of inputting performance data based on a performance by a user;

a step of extracting a performance tendency of the user from the performance data inputted by said step of inputting;

a step of generating feeling information indicative of a mood or feeling of the user presumed on the basis of the performance tendency extracted by said step of extracting;

a step of acquiring tone color control information corresponding to the feeling information generated by said step of generating; and a step of setting a tone color parameter on the basis of the tone color control information acquired by said step of acquiring.

* * * * *